United States Patent [19]

Nothmann

[11] 4,048,920

[45] Sept. 20, 1977

[54] MOISTURE SYSTEM CONTROL APPARATUS

[75] Inventor: Gerhard A. Nothmann, Wilmette, Ill.

[73] Assignee: Addressograph-Multigraph Corporation, Cleveland, Ohio

[21] Appl. No.: 710,401

[22] Filed: Aug. 2, 1976

[51] Int. Cl.[2] ..... B41F 7/26

[52] U.S. Cl. ..... 101/148

[58] Field of Search ..... 101/350, 363, 364, 349, 101/148, 204, 207, 208, 210

[56] References Cited

U.S. PATENT DOCUMENTS

| | | | |
|---|---|---|---|
| 2,728,292 | 12/1955 | Harless et al. | 101/363 |
| 2,821,911 | 2/1958 | Mestre | 101/148 X |
| 2,950,677 | 8/1960 | Staley | 101/350 |
| 2,990,770 | 7/1961 | Lindemann | 101/364 |
| 3,387,558 | 6/1968 | McClain | 101/148 |
| 3,507,215 | 4/1970 | Schuhmann | 101/148 |
| 3,552,312 | 4/1968 | Schinke | 101/363 X |

*Primary Examiner*—J. Reed Fisher
*Attorney, Agent, or Firm*—Russell L. Root

[57] ABSTRACT

A moisture system control apparatus is provided for metering the rate of feed of dampening fluid from a fountain apparatus including a fountain roller to a master on a master cylinder of a lithographic duplicating machine. The control apparatus comprises a linkage for converting continuous rotary input motion to incremental rotation of the fountain roller, and infinitely variable selector apparatus for adjusting the magnitude of the rotation increments employed during a first mode of operation which obtains while printing is in progress. Trip apparatus is provided for establishing a second mode of operation, in response to non-feeding of a copy sheet, in which the magnitude of the incremental rotations of the fountain roller are reduced from that obtaining during the first mode of operation to maintain the rate of feed of the dampening fluid at a low level while the machine is idling and copy sheets are not being duplicated, and for restoring the operation of the fountain roller from the second mode of operation to the first in response to a copy sheet being fed and the printing operation resumed.

10 Claims, 4 Drawing Figures

MOISTURE SYSTEM CONTROL APPARATUS

BACKGROUND OF THE INVENTION

In a lithographic duplicating process, an image to be reproduced is placed on a lithographic master and the master is attached to a master cylinder of the duplicating machine. The image on the master attracts the grease-base ink and repels water, while the non-image or background portions of the master attract water and repel ink.

With each revolution of the master cylinder, the film of water or dampening fluid and the film of ink are replenished on the surface of the master on the cylinder. The water allows the ink film to adhere only to the image areas of the master that are to be reproduced. Thereafter, the film of ink is transferred from the image on the master to a blanket on a blanket cylinder and from there to a copy sheet as it passes between the blanket and impression cylinders.

Because of variable factors such as humidity, temperature, the type of master and copy paper being used, etc., all of which have an influence on the quality of the copy reproduced and to a great extent determine the amount of water or dampening fluid that should be supplied to the master, control and metering of the water is critical in the production of high quality duplicated copies.

There are many known devices for controlling the rate feed of dampening fluid in offset duplicating machines, and it is customarily found convenient to effect this control by means of an adjustable drive for incremental rotation of the fountain roller by selected increments. The fountain roller conveys the fluid to a roller of a moisture roller train which transfers the fluid via other rollers in the train to the master on the master cylinder of the machine.

While such devices have been fairly successful, they are somewhat limited in being able to control the rate of feed of the dampening fluid in extremely precise and accurately metered quantities. Further, operation of these devices require a certain amount of skill in order to obtain the proper moisture balance for the particular requirements of the duplicating process. Thus, devices of this kind are not simple and easy to use by clerical personnel operating office-type duplicating machines, who are normally unskilled in the printing trade.

One of the steps normally required to assure adequate quality of the copies produced in this process is to properly time the turning on and turning off of the moisture system in accordance with the feeding of sheets through the duplicator. For example, it is essential to turn on the moisture system early enough so that the first sheet of a new run receives an adequate film of moisture. Providing the appropriate automaticcontrols to accomplish this is accordingly an important purpose of this invention.

A moisture control apparatus providing for infinitely variable control and adjustment for precisely metering the rate of feed of the dampening fluid supplied to the master is disclosed in copending application Ser. No. 678,219, filed Apr. 19, 1976, assigned to the assignee of the present invention.

As disclosed therein, the apparatus comprises linkage means for converting continuous rotary input motion to incremental rotation of the fountain roller. The apparatus includes a drive link for imparting motion to the fountain roller and a control link for controlling the magnitude of incremental rotation, the drive and the control links being supported on independent pivots but both being swingable about a common adjustably positionable fixed pivot. The frequency of the incremental rotation of the fountain roller is proportional to the rotational speed of the duplicator, and the magnitude of the individual roller incremental motions is substantially proportional to an angle formed between the drive and the control links as determined by the position of the fixed pivot which is selectively settable to an infinitely variable position.

The foregoing apparatus provides a highly successful arrangement for controlling the rate of feed of the dampening fluid in extremely precise and accurately metered quantities. It also provides a device which is simple and easy to use by machine operators who are relatively unskilled in the printing trade.

SUMMARY OF THE INVENTION

The present invention provides all of the advantages of the control apparatus of the copending application referred to supra, and additionally provides a simple and inexpensive means associated with the control apparatus for maintaining the moisture roller train at a low level to prevent an improper ink-moisture balance resulting from drying-out of the roller train while the duplicator is operating but sheets are not being fed. Further, the device of the present invention utilizes fewer parts and is generally of simpler construction and, therefore, is less costly to produce than the device of the copending application.

The apparatus comprises linkage means for converting continuous rotary input motion to incremental rotation of the fountain roller, including an actuator link for imparting rotative motion to a drive arm which in turn imparts motion to and controls the magnitude of incremental rotation of the fountain roller. The actuator link and the drive arm are supported on the axis of the fountain roller and the actuator link is swingable into and out of abutting engagement with the drive arm for imparting motion to the drive arm and the fountain roller. The apparatus also includes an instantaneously acting one-way clutch to permit unidirectional rotation of the fountain roller, and an instantaneously acting one-way brake to prevent retrograde movement of the fountain roller after each incremental motion of the fountain roller.

The frequency of the incremental rotation of the fountain roller is proportional to the rotational speed of the duplicator and the magnitude of the individual roller incremental rotational motions is substantially dependent on the angle formed between the actuator link and the drive arm as determined by the position of the drive arm which is selectively settable to an infinitely variable position defining a first mode of operation. The infinitely variable setting of the drive arm provides substantial latitude in the ability to accurately meter the rate of feed of the dampening fluid to correspond to the requirements of the duplicating process.

The apparatus also includes a trip means, operable in response to non-feeding of a copy sheet, for reducing the magnitude of the fountain roller incremental rotation from the first mode to a second mode to maintain the rate of feed of dampening fluid at a low level while the machine is idling, i.e., operating without feeding sheets. The trip means comprises a movable barrier member operable from an inactive to an active position for moving the drive arm from a position suited to the first mode of operation to one suited to the second mode of operation, whereby the actuator link imparts motion to the drive arm of a magnitude significantly reduced from the motion imparted in the first mode, and the fountain roller is moved in increments of predetermined and reduced magnitude. The movable barrier member is returned to the inactive position and the drive arm is restored to the first mode in response to feeding of a copy sheet and resumption of the printing operation.

It is an object of the invention to provide improved dampening fluid metering apparatus with infinitely variable control means, adjustable to a selected position within a wide range of positions such that the incremental rotation imparted to the fountain roller may be set with micrometer accuracy, for precisely and uniformly metering the rate of feed of the fluid from a fluid supply to a master on the master cylinder of the machine.

Another object is to provide a trip means operatively associated with the control means for reducing the rate of feed of the fluid from a selectively settable normal level to a low level in response to non-feeding of a copy sheet when the machine is idling, and for restoring the rate of feed of the fluid from the low level to the normal level in response to a copy sheet being fed and the printing operation resumed.

A feature of the invention is to provide a dampening fluid metering control apparatus embodying the foregoing properties which is also economical to produce, reliable in operation, simple and easy to use, and one which may be readily installed on existing machines without major modification thereof.

Other objects, features and advantages of the invention will appear hereinafter as the description proceeds.

IN THE DRAWING

DESCRIPTION OF THE PREFERRED EMBODIMENT

Figure 1:
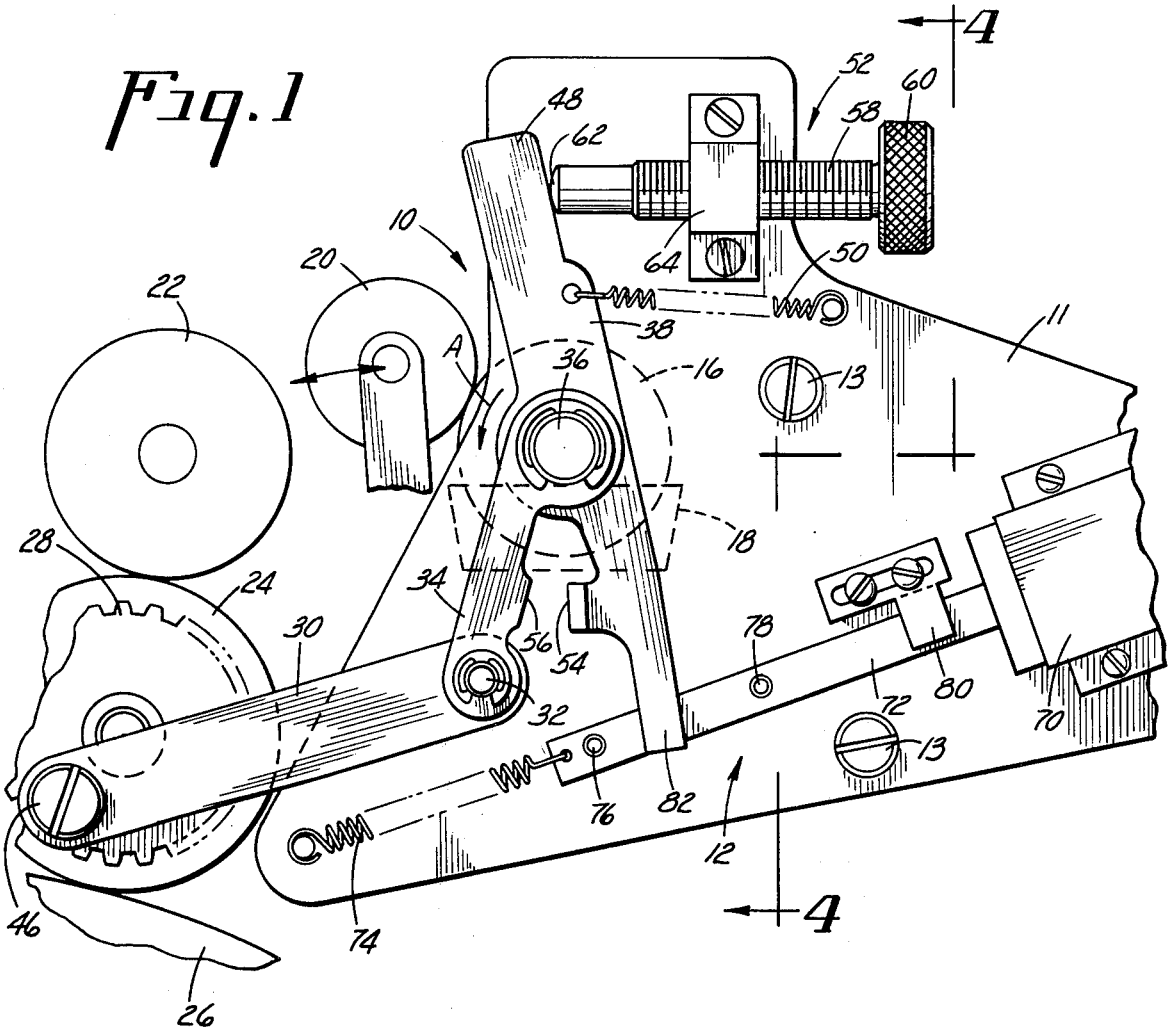
FIG. 1 is a side elevation of a moisture system control apparatus in accordance with the present invention showing the apparatus in a first mode of operation during feeding and duplicating of copy sheets.
Figure 2:
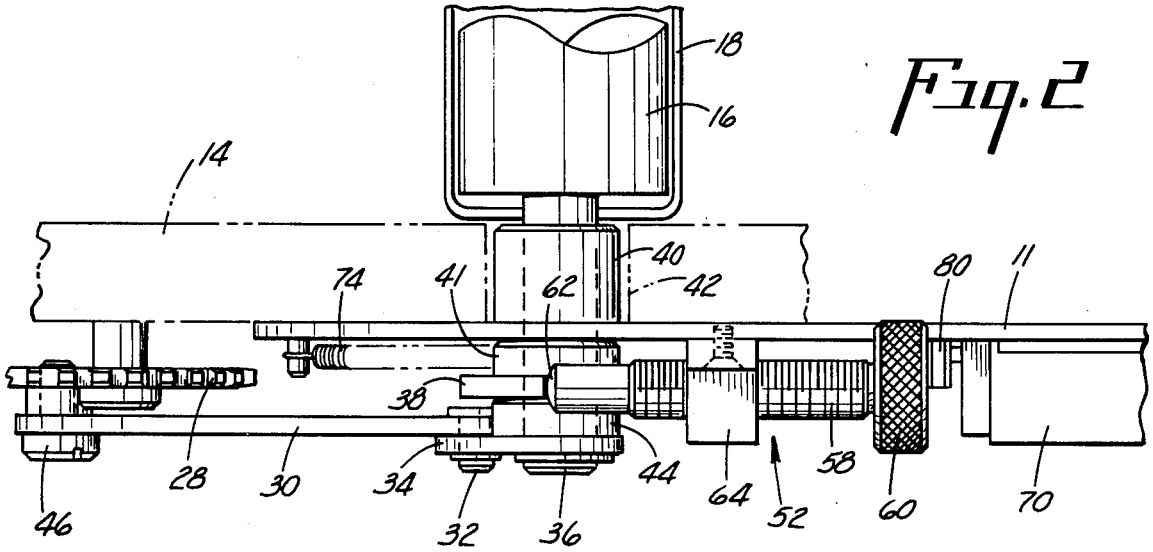
FIG. 2 is a partial plan view of the apparatus of FIG. 1.
Figure 4:
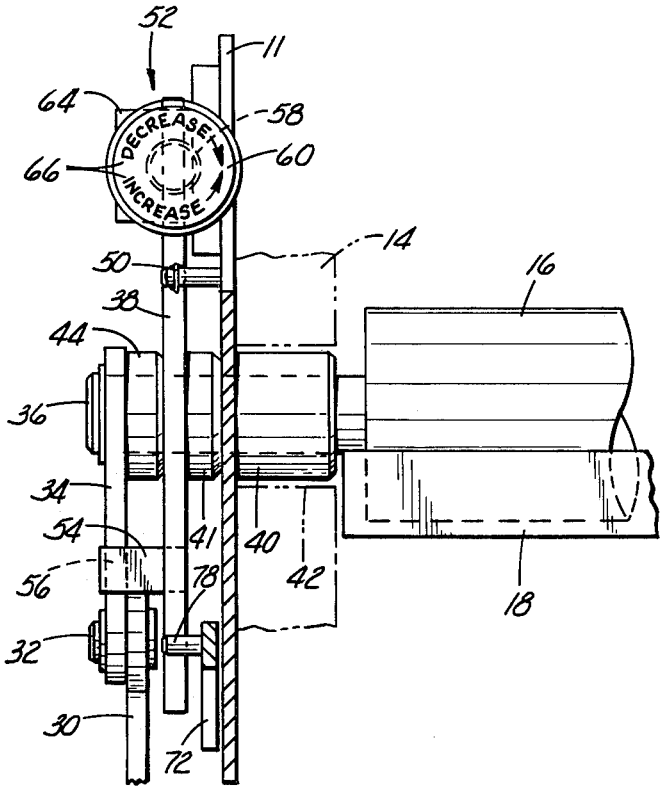
FIG. 4 is a section as viewed on the line 4—4 in FIG. 1.

As shown in FIGS. 1 and 2, the control and the trip means are indicated generally by the reference numerals 10 and 12 respectively, and are mounted on a mounting plate 11 secured by screws 13 to one of a pair of side plates 14 of the duplicating machine, only one side plate 14 being shown in phantom in FIGS. 2 and 4. A fountain roller 16 is supported in the side plates 14 and is adapted to be rotated intermittently to transfer dampening fluid from a fountain 18 to a ductor roller 20. The ductor roller 20 transfers the fluid to a distributor roller 22 in contact with a form roller 24 which applies the fluid to a master on a master cylinder 26.

The control apparatus 10 also comprises a rotary drive element such as a gear 28 driven from the machine drive for imparting reciprocating motion to an operator link 30 provided with a pin 32 for connection with one end of an actuator link 34. The other end of the actuator link 34 is supported for swinging motion about a shaft 36 of the fountain roller 16. A drive arm 38 is drivingly mounted on the shaft 36 of the fountain roller 16.

The fountain roller 16 is rotatably supported in the side plates 14 and, as shown in FIGS. 2 and 4, the shaft 36 extends outwardly beyond the side plate 14. A hub 40 is provided integral with the mounting plate 11 and is positioned within a suitable opening 42 in the side plate 14. The hub 40 houses suitable bearing means for rotatably supporting the shaft 36 of the fountain roller 16.

The actuator link 34 is provided with a hub 44 integral therewith and the hub 44 houses suitable bearing means for supporting the actuator link 34 for rocking motion on the shaft 36. Further, the drive arm 38 is provided with a hub 41 which houses a one-way roller clutch to permit unidirectional rotation of the fountain roller 16, and the hub 40 houses a one-way roller brake to prevent retrograde movement of the fountain roller 16 subsequent to each incremental rotation of the fountain roller in the direction of arrow A as shown in FIG. 1.

While the one-way clutch and the one-way brake are described as being of the roller type, other one-way clutches and brakes could be used such as, for example, a one-way helical spring clutch and brake. Any type of one-way clutch or brake device which acts instantaneously without any significant mechanical delay upon reversal of direction will serve as well, and accordingly, the expressions instantaneously acting one-way clutch and instantaneously acting one-way brake as used herein are intended to cover all types of clutches and brakes of this character.

The operator link 30 is pivotally supported on a shoulder screw 46 which secures the operator link to the drive gear 28. The drive gear 28 is adapted to be driven continuously as long as the master cylinder 26 is being rotated, and is driven at a speed having a predetermined relationship to the speed of the master cylinder 26. Thus, the fountain roller 16, for any given adjustment of the moisture control, is moved at a frequency proportional to the rotational speed of the master cylinder whatever the speed setting of the duplicating machine. For the purposes of this discussion, this relationship will be referred to as incrementally rotating the fountain roller in time with the master cylinder. The rotary motion of the drive gear 28 imparts reciprocating motion to the operator link 30 which imparts swinging motion to the actuator link 34 about the shaft 36. This motion is converted to oscillating motion of the drive arm 38, as a result of the actuator link 34 abutting and imparting rocking motion to the drive arm, for incrementally rotating the fountain roller 16 in increments of selectively variable magnitude.

The fountain roller 16 and the moisture roller train comprising the rollers 20, 22 and 24 are so arranged that the ductor roller 20 ducts between the fountain roller and the distributor roller 22 approximately three times in each revolution of the master cylinder 26. The duration of contact of the ductor roller with the fountain roller provides, as a minimum, for the ductor roller to remain in contact with the fountain roller at least during the period that the fountain roller is being moved through its individual incremental motions.

Figure 3:
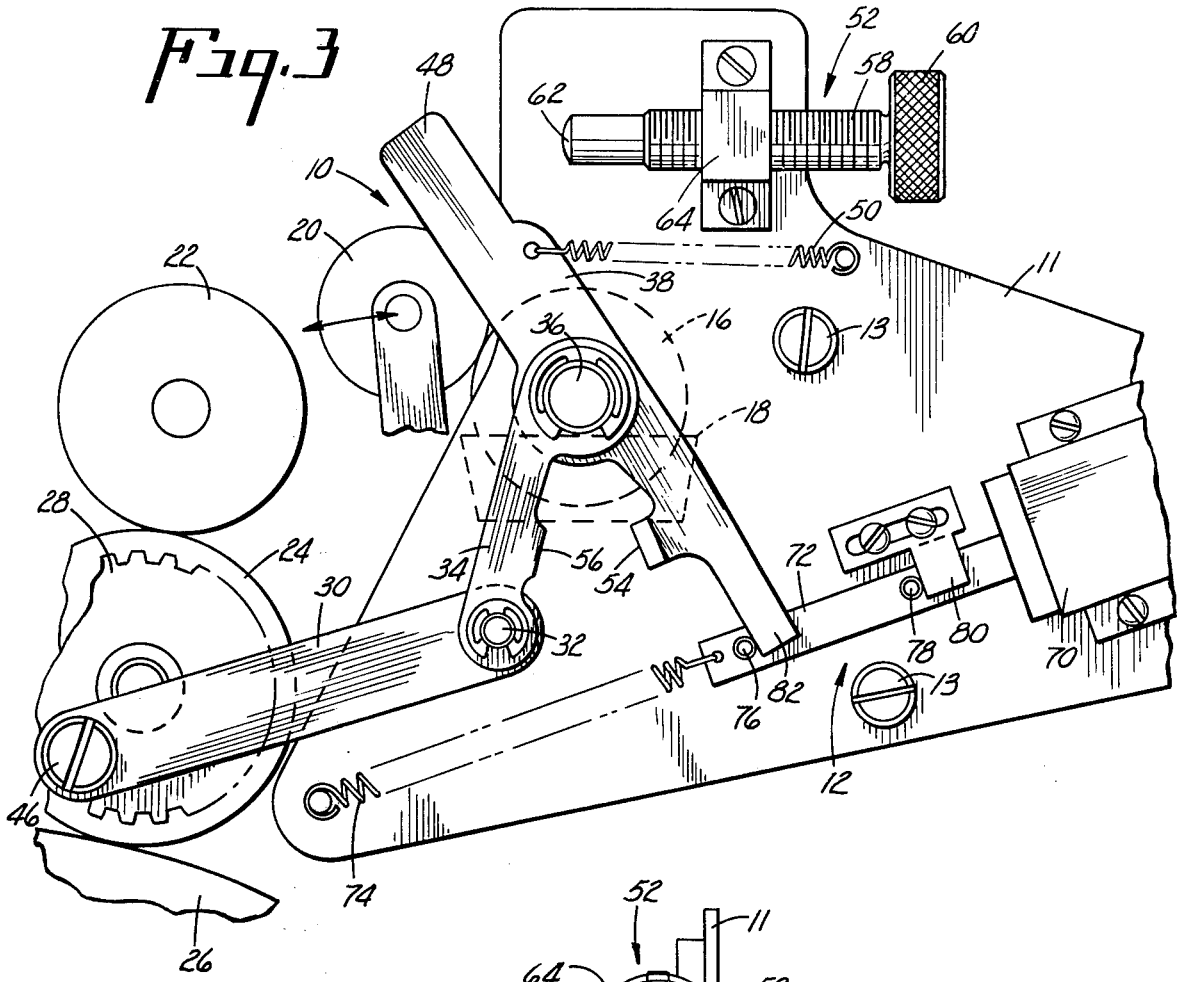
FIG. 3 is a side elevation similar to FIG. 1 but showing the apparatus in a second mode of operation during non-feeding of copy sheets while the machine is idling.

As shown in FIGS. 1 and 3, the drive arm 38 is adapted for oscillating movement and is biased in a clockwise direction by a spring 50 urging an upper end 48 of the drive arm 38 against a selector member indicated generally by the reference numeral 52. Through adjustable movement of the selector member 52, which will be described hereinafter, the drive arm 38 is positionable at any of various desired selected set positions defining a first mode of operation, in which an abutment surface 54 of the drive arm is spaced closer to or further from a striker surface 56 of the actuator link 34, accordingly decreasing or increasing respectively, the angular clearance spacing between the actuator link 34 and the drive arm 38. Preferably, the abutment surface 54 and the striker surface 56 are made or covered with resilient-durable material to avoid excessive noise and wear.

The reciprocating motion of the operator link 30 swings the actuator link 34 to move the striker surface 56 into and out of contact engagement with the abutment surface 54. As shown in FIGS. 1 and 3, movement of the striker surface 56 into engagement with the abutment surface 54 imparts counterclockwise movement to the drive arm 38 and movement of the striker surface out of contact with the abutment surface 54 permits the drive arm to be restored to its set position under the bias of the spring 50. The magnitude of travel of the drive arm in its counterclockwise movement is determined by the separation or angular spacing between the actuator link 34 and the drive arm 38. This magnitude of travel controls the magnitude of the incremental motions of the fountain roller to a desired value within a normally functional range by infinitesimal degrees.

The selector member 52 for setting the control means 10 and, specifically, the drive arm 38 to a selected position for obtaining a desired magnitude of incremental motion of the fountain roller 16, and hence an accurate and uniform metered rate of feed of the dampening fluid, comprises a threaded member or screw 58 provided with a head 60 and a nose 62. The screw 58 is mounted in a threaded support 64 provided on the mounting plate 11 and is adapted to be rotated to move the nose 62 so as to act as a stop for the upper end 48 of the drive arm 38, either forcing it towards the left in FIG. 1 or allow it to move to the right under the influence of the spring 50.

The face of the head 60 may be provided with suitable markings 66 (FIG. 4) indicating the proper direction of screw rotation for increasing or decreasing the rate of feed of the fluid. As the screw 58 is rotated in a clockwise direction as viewed in FIG. 4, the selector member 52 is moved from right to left as viewed in FIG. 1 thereby moving the drive arm 38 in a counterclockwise direction to increase the angular spacing between the actuator link 34 and the drive arm. Hence, the abutment surface 54 of the drive arm 38 is spaced further from the striker surface 56 such that the swinging motion of the actuator link imparts a reduced magnitude of travel to the drive arm resulting in rotation of the fountain roller 16 in increments of a reduced magnitude and a reduced supply of fluid to the master cylinder 26.

When the screw 58 is rotated in the opposite direction, the selector member 52 is moved from left to right as viewed in FIG. 1 thereby causing the drive arm 38 to move in a clockwise direction, under urging of the spring 50, to decrease the angular spacing between the actuator link 34 and the drive arm. Thus, the abutment surface 54 is spaced closer to the striker surface 56 such that the swinging motion of the actuator link imparts an increased magnitude of travel to the drive arm resulting in rotation of the fountain roller 16 in increments of an increased magnitude and an increased supply of fluid to the master cylinder.

If desired, the markings 66 may include digits positionable to a fixed pointer to aid the machine operator in setting the drive arm 38 to a desired position for accurately metering the rate of feed of the fluid. This arrangement provides a wide range of adjustment between the upper and the lower limit of the magnitude of incremental rotation that may be imparted to the fountain roller 16. The drive arm 38 may be positioned by rotating the screw 58 to any selected setting, whereby the angular spacing between the actuator link 34 and the drive arm 38 varies the effective length of the output stroke (angle of oscillation of the drive arm 38) from zero to maximum movement.

Although the foregoing operation might be performed utilizing a conventional pawl and ratchet arrangement for intermittently rotating the fountain roller, such an arrangement is limited to advancement of the ratchet wheel by one tooth per stroke of the pawl in the minimum drive position, and this amount of advancement cannot be reduced by employing ratchet teeth of a finer pitch without sacrificing reliability in the way of the pawl failing to properly engage the teeth and advance the ratchet. Hence, such a device does not provide for setting the apparatus for anything other than movement of the fountain roller a distance corresponding to movement of the ratchet wheel by a whole number, or by whole numbers, of teeth, i.e., the angle of rotation of the output can be adjusted only in multiples of one full ratchet tooth.

The trip means 12 provides for establishing a second mode of operation in which the magnitude of the incremental motions of the fountain roller is reduced from the first mode of operation to maintain the rate of feed of the fluid to the moisture roller train at a low level while the machine is idling and copy sheets are not being duplicated, and for restoring the operation from the second to the first mode in response to a copy sheet being fed and the duplicating operation resumed.

As shown in FIGS. 1 and 3, the trip means 12 comprises power means such as a solenoid 70 having a plunger 72 normally biased outwardly of the solenoid by a spring 74. The plunger is provided with a movable barrier member or pin 76, and a stop pin 78 adapted to act against an adjustable stop member 80. Although not shown in the drawing, the solenoid 70 is in an electrical circuit which provides that it can be energized by means for detecting the absence of a copy sheet at a predetermined point in the sheet path of the machine, and deenergized by means for detecting the presence of a sheet. While copy sheets are being fed and duplicated, the solenoid 70 is in a deenergized state and the movable barrier member 76 is in an inactive position as shown in FIG. 1, and the control means 10 is in the first mode of operation whereby the rate of feed of the fluid supplied to the master cylinder is metered in accordance with the setting of the drive arm 38 by the selector member 52. However, in response to detection of the absence of a copy sheet in the sheet path, indicating an interruption in the duplicating operation, a signal is generated to energize the solenoid 70 thereby drawing the plunger 72 inwardly, against the bias of the spring 74, and moving the movable barrier member 76 from the inactive to an active position as shown in FIG. 3. This movement of the plunger 72 causes the movable barrier member 76 to strike a lower end 82 of the drive arm 38 thereby rotating the drive arm in a counterclockwise direction and positioning the stop pin 78 against the adjustable stop 80. The stop 80 is selectively positionable relative to the stop pin 78, and fixed against movement at the desired selected position. to control the amount of inward movement of the plunger 72 and, of course, the amount of movement imparted to the drive arm 38 by the movable barrier member 76.

With the solenoid 70 in an energized state and the control means 10 in the second mode of operation as shown in FIG. 3, the upper end 48 of the drive arm 38 is out of engagement with the nose 62 of the selector member 52 and the drive arm is held in this predetermined position by the movable barrier member 76 against the bias of the spring 50. Thus, because the abutment surface 54 is now spaced further from the striker surface 56 of the actuator link 34, the magnitude of travel imparted to the drive arm 38, by the swinging motion of the actuator link 34, is greatly reduced from the magnitude of travel of the drive arm when operating in the first mode.

Through the setting of the adjustable stop 80, the degree of travel of the drive arm may be accurately controlled to a predetermined setting such that the drive arm 38 continues to effect incremental motions of the fountain roller 16, but of a reduced magnitude, to maintain a low level supply of fluid to the moisture roller train to prevent drying-out thereof when copy sheets are not being fed and the machine is idling.

The foregoing operation continues while the machine is idling and until such time as a copy sheet is again fed and detected in the sheet path. In response thereto, the solenoid 70 is deenergized causing the plunger 72 to be drawn outwardly by the spring 74, the movable barrier member 76 is restored from its active to inactive position and the drive arm 38 is restored by the spring 50 to the first mode of operation wherein the upper end 48 of the drive arm is in engagement with the nose 62 of the screw 58 as shown in FIG. 1. Thus, the control means 10 is actuated between the first and the second mode of operation solely in response to the presence and absence respectively, of a copy sheet in the sheet path and does not require any intervention on the part of the machine operator.

It will be appreciated that the present invention provides a control means adjustable to a selected position within a wide range of positions, for operation in the first mode, such that the incremental rotation imparted to the fountain roller may be set with micrometer accuracy. Also, the trip means provides for conditioning the control means for operation in the second mode for supplying a reduced amount of fluid, by reducing the magnitude of the individual incremental motions of the fountain roller, in response to non-feed of copy sheets while the machine is idling to maintain the moisture roller train at a low moisture level. The trip means provides for restoring the control means from the second to the first mode of operation in response to detection of a copy sheet fed into the sheet path, and both the first and the second mode operations are effected without machine operator intervention.

Further, the apparatus is simple in construction and use whereby operators relatively unskilled in the printing trade can quickly and easily set the proper moisture balance for obtaining high quality duplicated copies, especially in those applications wherein the duplicating machine is equipped with a non-molleton moisture roller system, and without concern of the moisture roller train drying-out during machine idling and requiring a pre-moistening operation prior to initiating subsequent feeding of copy sheets.

What is claimed is:

1. In a lithographic duplicating machine having a main power source, a master cylinder and fountain means including a fountain roller for supplying dampening fluid to a master on the master cylinder, a control means for metering the rate of feed of the fluid, comprising:

drive means mechanically connected to said main power source for rotating the fountain roller unidirectionally in intermittent increments in time with the master cylinder and operable in a first mode to control the feed of dampening fluid during a printing operation;

means for adjusting the drive means to set the magnitude of the incremental motions of the fountain roller to a desired value by infinitesimal degrees, with respect to operation of the drive means in said first mode; and means for overriding the adjusting means and shifting the drive means into a second mode of operation which rotates the fountain roller in substantially shorter intermittent increments than those which characterize the printing operation so as to meter the feed of the fluid at a rate substantially reduced from the rate of feed of the fluid obtaining during the first mode and for maintaining the drive means in said second mode during non-printing operation while the machine is idling, and also for shifting the drive means from the second mode into the first mode and maintaining the same in said first mode during a printing operation.

2. A duplicating machine as set forth in claim 1 in which the means to shift the drive means includes means to cause the shift from the first to the second mode of operation in response to non-feeding of a copy sheet, and to cause the shift from the second to the first mode of operation in response to feeding of a copy sheet to be printed.

3. A duplicating machine as set forth in claim 1 in which the drive means comprises a drive arm rockable about the axis of the fountain roller and biased in one direction by a spring:

a one-way clutch connecting the drive arm with the fountain roller for driving the latter in one direction of rotation;

a one-way brake preventing retrograde motion of the fountain roller;

a swinging link rockable about the axis of the fountain roller;

contact means on said link and drive arm whereby the drive arm is driven by the link in opposition to said spring through a portion of the travel of the link; and means to swing the link in time with the rotation of the master cylinder.

4. A duplicating machine as set forth in claim 3 in which the adjusting means comprises selector means for positioning the drive arm at a selected initial angular location about the fountain roller axis in opposition to the spring so as to control the proportion of the swinging travel of the link during which the contact means are engaged and the drive arm moves therewith.

5. A control means as set forth in claim 4 in which the selector means comprises a stop screw arranged for contact with the drive arm.

6. A lithographic duplicating machine as set forth in claim 3 in which the means for overriding the adjusting means and shifting the drive means between the first and second modes of operation comprises:

a movable barrier member arranged to be shifted to an active position in contact with the drive arm to restrict its normal rocking ambit, and to be shifted to an inactive position in which it is free of the drive arm to restore its normal rocking ambit;

power means to shift the barrier member to active position; and spring means to restore the barrier member to inactive position.

7. A lithographic duplicator as set forth in claim 6 which further includes adjustable stop means for determining the location of the active position of said barrier member.

8. In a lithographic duplicating machine having a master cylinder and fountain means including a fountain roller for supplying dampening fluid to a master on the master cylinder, a control means for metering the rate of feed of the fluid, comprising:

drive means for incrementally rotating the fountain roller unidirectionally in time with the master cylinder and operable to control the feed of dampening fluid during a printing operation, said drive means including:

a drive arm rockable about the axis of the fountain roller and biased in one direction by a spring;

a one-way clutch connecting the drive arm with the fountain roller for driving the latter in one direction of rotation;

a one-way brake preventing retrograde motion of the fountain roller;

a swinging link rockable about the axis of the fountain roller;

contact means on said link and drive arm whereby the drive arm is driven by the link in opposition to said spring through a portion of the travel of the link; and means to swing the link in time with the rotation of the master cylinder.

9. A duplicating machine as set forth in claim 8 which further includes means for adjusting the magnitude of the incremental motions of the fountain roller to a desired value in which the adjusting means comprises selector means for positioning the drive arm at a selected initial angular location about the fountain roller axis in opposition to the spring so as to control the proportion of the swinging travel of the link during which the contact means are engaged and the drive arm moves therewith.

10. A control means as set forth in claim 9 in which the selector means comprises a stop screw arranged for contact with the drive arm at a location to determine the limit of movement of the drive arm under influence of the spring.

* * * * *